United States Patent [19]

Dillhoff

[11] Patent Number: 4,747,588

[45] Date of Patent: May 31, 1988

[54] UNIVERSAL CLAMPING TOOL

[76] Inventor: George A. Dillhoff, 1301 Furnas Rd., Vandalia, Ohio 45377

[21] Appl. No.: 896,898

[22] Filed: Aug. 15, 1986

[51] Int. Cl.[4] ..... B25B 1/00

[52] U.S. Cl. ..... 269/6; 269/258; 81/418

[58] Field of Search ..... 269/6, 249, 237, 257, 269/902, 228, 258; 81/418, 420

[56] References Cited

U.S. PATENT DOCUMENTS

| | | | |
|---|---|---|---|
| 57,447 | 8/1866 | Stockmar . | |
| 938,376 | 10/1909 | Friday | 81/418 |
| 4,034,971 | 7/1977 | Tsuyama | 269/249 |
| 4,305,575 | 12/1981 | Bardes | 269/41 |
| 4,327,902 | 5/1982 | Holmes | 269/6 |
| 4,378,937 | 4/1983 | Dearman | 269/6 |
| 4,483,059 | 11/1984 | Dearman | 29/272 |
| 4,601,221 | 7/1986 | Kalkbrenner et al. | 81/418 |

*Primary Examiner*—Frederick R. Schmidt
*Assistant Examiner*—Judy J. Hartman
*Attorney, Agent, or Firm*—Biebel, French & Nauman

[57] ABSTRACT

A clamping tool for use in clamping and supporting a wide variety of elongated pieces for welding has a pair of generally C-shaped arms which support a pair of opposed L-shaped clamping members, one for each arm. Each clamping member has a long leg and a short leg which extends perpendicular to the long leg, and each clamping member is supported on one of the arms for pivotal movement about two axes.

2 Claims, 4 Drawing Sheets

100
46
45
23
22

46
45
98
23
22

46
48
49
95
96
45
23
22

46
48
49
105
45
23
22

UNIVERSAL CLAMPING TOOL

BACKGROUND OF THE INVENTIONS

Clamping tools have been suggested for the purpose of supporting sections of pipe, I-beams or the like to be welded, in which the clamping members are mounted on a self-locking C-clamp. Examples of such prior devices include the patents of Stockmar U.S. Pat. No. 57,447 of Aug. 21, 1866; Bardes, U.S. Pat. No. 4,305,575 of Dec. 15, 1981; Bardes, U.S. Pat. No. 4,238,123 of Dec. 9, 1980; Holmes, U.S. Pat. No. 4,327,902 of May 4, 1982; Dearman, U.S. Pat. No. 4,378,937 of Apr. 5, 1983; and Dearman, U.S. Pat. No. 4,483,059 of Nov. 20, 1984.

In the prior devices noted, each arm or jaw of a locking tool is provided with a workpiece gripping member which is pivotally or movably mounted with respect to the arm, to permit the gripping member to have a certain degree of alignment or movement with respect to a workpiece being clamped. While the arrangements as shown and described in the above identified prior patents are useful for supporting a variety of different articles, each lacks an ability to hold and support a wide variety of workpieces of substantially differing shapes or configurations. In fact, with the possible exception of Stockmar, each is particularly designed for the purpose of supporting workpieces of specific or limited configurations. Further, the prior devices shown generally lack the ability to support simultaneously, two or more articles of substantially differing configurations, such as cylindrical pipe and flat plates, beams, or rectangular plates. Also, they lack the versatility of holding, for example, pipes of differing sizes, I-beams, channel beams, flat stock, rod stock, either singly or in combination with other pieces. Accordingly, a need exists for a more univeral and versatile clamping tool.

SUMMARY OF THE INVENTION

The present invention is directed to a universal clamping tool in which the clamping arms are provided with jaws in the form of a generally L-shaped workpiece engaging clamping members or supports mounted on the arms for substantially universal movement. The L-shaped supports are supported and mounted on a back surface of the longer leg with the shorter leg extending forwardly therefrom toward the opposite support. Each support may be pivoted about two intersecting axes so that the position of the shorter leg with respect to the longer leg may be set in any rotational position with respect to the opposite member, and the plane of the legs may be similarly pivoted to the full extent permitted by the supports themselves. Sice both gripping members are universally mounted, or mounted for movement about two axes of rotation, there is provided a high degree of versatility in the positioning of the workpiece gripping members, so that oddly shaped pieces and mutiple pieces can be supported therebetween.

The employment of L-shaped jaw members, preferably identical to each other, with a longer leg and a shorter transversely extending leg, and with a length ratio of approximately 1 to 3, has been found to provide a most versatile arrangement. For example, the short legs may be positioned, one up and one down, or one inverted with respect to the other, to form in effect a space of rectangular size when the support arms are brought together, enclosed on four sides by the four respective sections of the two L-shaped support members. On the other hand, by arranging the members in complementary fashion, the shorter sections will approach or contact each other along their inner marginal edges and at the same time the longer sections will approach or contact each other, with the result that a somewhat triangular or diamond-shaped opening is formed, which permits the gripping of a wide variety of shapes and combinations of shapes.

It is accordingly an important object of this invention to provide a gripping and clamping tool having a pair of universally positionable jaw members of generally L-shaped configuration.

A further object of the invention is the provision of a clamp, as outlined above, particularly adapted for supporting a wide variety of stock material and workpieces for welding or the like.

A still further object of the invention is the provision of a C-type clamp in which the clamping jaws or gripping members are of a generally L-shaped configuration.

These and other objects and advantages of the invention will be apparent from the following description, the accompanying drawings, and the appended claims.

DETAILED DESCRIPTION OF THE PREFERRED EMBODIMENT

Figure 1:
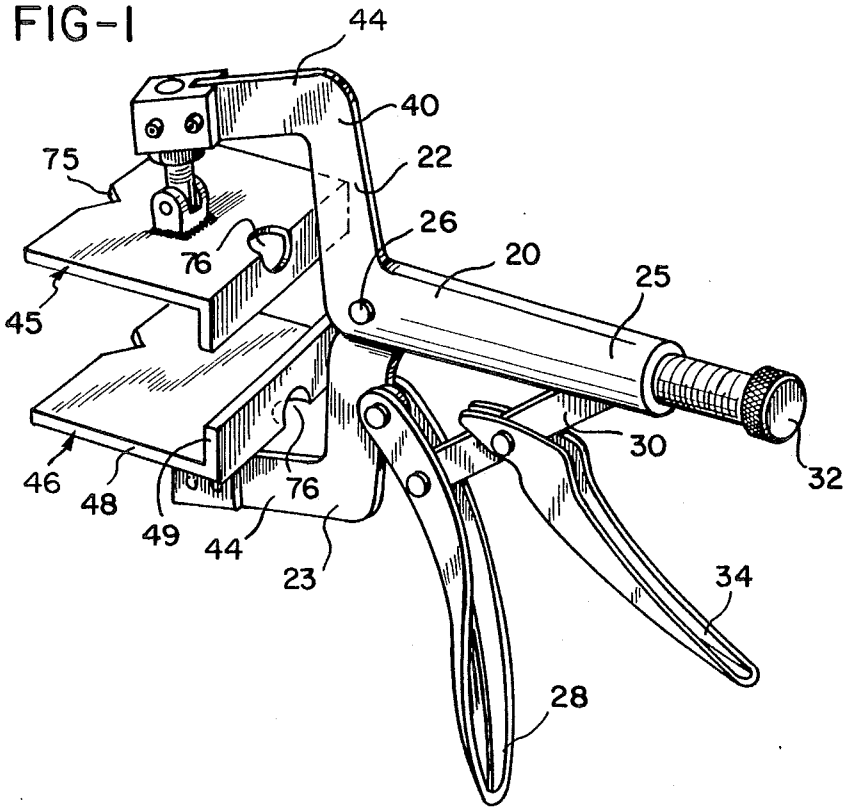
FIG. 1 is a perspective view of a clamping tool according to this invention.

Referring to the drawing which illustrate a preferred embodiment of the invention, a clamping tool made according to this invention is illustrated in FIG. 1 as including a lever-operated C-clamp 20. The clamp 20 has a pair of clamping arms 22 and 23, the arm 22 being generally integral with a handle 25 and the arm 23 being pivoted to the handle 25 on a pivot 26 The actuating mechanism for the pivoted arm 23 includes the channel-like lever 28 which is pivoted on the bar 30, the position of which bar may be adjusted by a screw 32. The bar 30 also supports an intermediate release lever 34. The operating mechanism for operating the arms 22 and 23 of the clamping tool 20 may be constructed according to U.S. Pat. Nos. 2,280,005 and 2,514,130, to which reference may be made for further details of the operation of the actuating levers and the adjusting mechanism.

Figure 3:
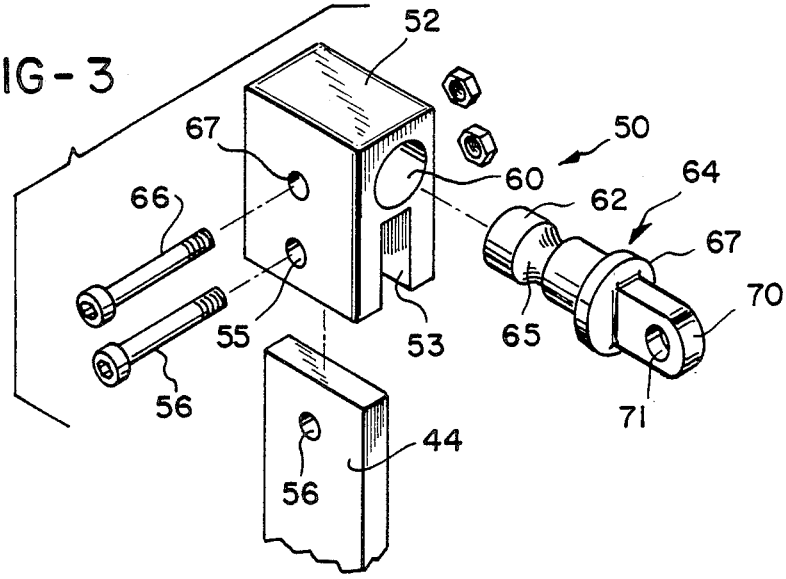
FIG. 3 is an exploded perspective view of the clamping member mounting arrangement for the clamping tool.

This invention makes use of the wide C-clamp versions of the clamping tools of the general kind described above. For this purpose, the arms are formed widely spread apart with outwardly extending portions 40 and forwardly extending portions 42 and terminated in opposed rectangular square-cut ends 44 (FIG. 3). The arrangement of the operating mechanism of the tool is such that the arms 22 and 23 may be moved toward each other so as to provide between the confronting ends 45 of the arms a preselected spacing, and the arms may be latched in such position, and the latched position may be regulated by an adjustment of the screw 32.

The arms 22 and 23 carry workpiece-engaging jaws thereon of special configuration according to this invention, in the form of a pair of opposed, generally L-shaped clamping members 45 and 46. The clamping members may be of identical configuration, and are each formed of flat plate steel with a long leg 48 and a right angled short leg 49 which extends along an edge of the long leg. Therefore, the short legs 49 extend generally perpendicular to the long legs 48 and in a direction toward the opposite clamping member, and have a length which is about one-third to one-fourth that of the long leg. The opposed surfaces of the members are preferably flat although a gripping surface, such as a diamond or dimpled pattern, may be formed in these surfaces, if desired.

The clamp of this invention further includes means for mounting each of the clamping members 45 and 46 respectively to one of the arms 22 and 23. The clamping member mounting means includes a pivot support 50, as illustrated in FIG. 3, which provides for generally universal movement of the associated clamping member. More particularly, the support 50 permits rotational movement of the member about an axis which intersects or is in the plane of the associated arm, and about a second axis generally normal to the first axis. A particularly effective mounting means forming the pivotal support is illustrated in FIG. 3 as including a pair of identical saddle blocks 52. Each block 52 is formed with a partial slot 53 which permits the block 52 to be mountd in straddling relation over the end 44 of one of the arms 22, 23. The block 52 is held in place on the arm end by a partially threaded bolt 54 which passes through a clearance opening 55 in one side of the clock so as to intersect the slot 53, the block and another clearance hole 56 in the end 44 and into a tapped opening (not shown) opposite the opening 55.

The saddle block 52 is also formed with an opening 60 parallel to the slot 53 to receive the shank 60 of a shouldered swivel pin 64. The shank 62 of the pin 64 forms a close clearance fit in the opening 60, and is also formed with a circumferential groove 65. Another partially threaded bolt 66, similar to the bolt 54, extends into a tapped hole 67 and block 52, so that the shank of the bolt 66 intersects the groove 65 as a keeper for the pin 64, while providing for free rotational movement of the pin about its longitudinal axis.

The pin 64 is formed with a thrust shoulder 67 which bears against the adjacent flat surface of the block 52 in use, and is further formed with an extending support portion 70 fowardly of the shoulder 67 having a transverse opening 71. The support portion is proportioned to be received between a pair of raised spaced saddles 72 mounted centrally on the back surface of the long legs 48 of the clamping members 45, 46, as perhaps most clearly shown in FIG. 4. The pin is supported in place between the saddles 72 on a clevis pin 73, which provides for pivotal or hinge movement of the associated member 45, 46 about an axis transverse to that of the pin itself and generally parallel to the plane of the back of the long leg 48.

It will therefore be seen that the mounting means described permits the clamping members to swivel through at least 180° of rotation with respect to the associated jaw or arm along a one axis which is generally perpendicular to an end 44. The clamping members are also hinged for rocking motion at the clevis pin 73 along a second axis perpendicular to that of the first axis. Accordingly, either of the clamping members may be rotated or inverted with respect to the other, as illustrated in the several operational views.

For the purpose of facilitating the use of the tool, openings or notches may be formed in the clamping members, so as to permit the insertion of a welding rod, torch or the like. For this purpose, the edge 74 of the long leg may be formed with a V-notch, as shown at 75. Also, an access opening may be formed in the members at the intersection of the legs, as shown at 76 in FIG. 1. The particular shape of the clamping members and their freedom of movement, permit the tool to assume a wide variety of configurations, to grip and support a wide variety of workpieces.

Figure 2:
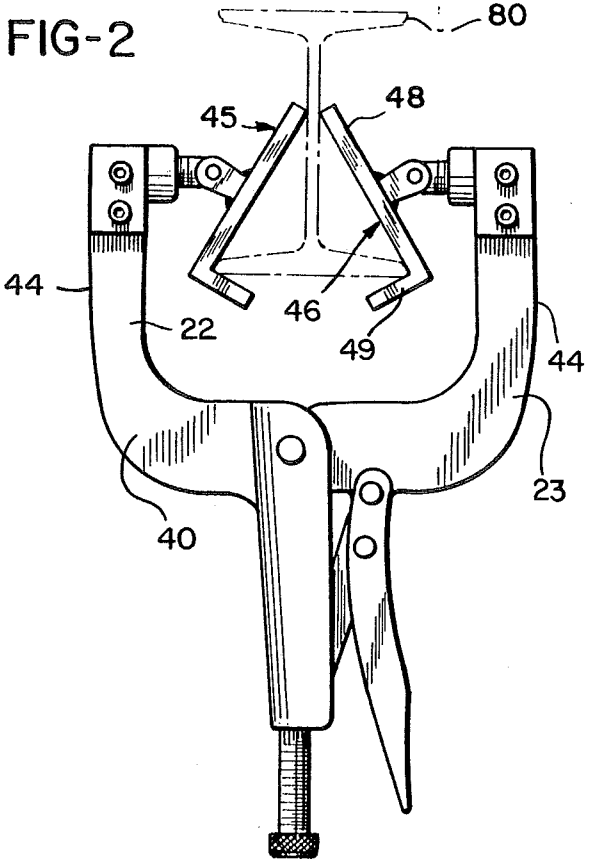
FIG. 2 is a side elevation of the tool, showing an I-beam shown in phantom.
Figure 4:
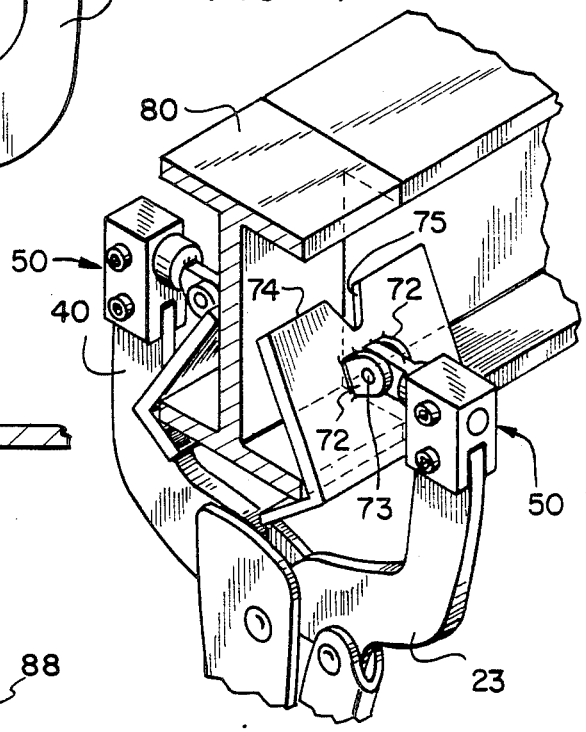
FIG. 4 is a perspective fragmentary view of the tool showing the clamping for tack welding a pair of butt-joined I-beams.

Two or more structural members, such as pipes, beams or plates, to be joined such as by tack welding (and later fully welded in a conventional manner) may be clamped by the tool of this invention. As previously noted, most tools of this kind are specialized and do not adapt themselves for use with a wide variety of conditions and requirements. In this invention, the clamping members may be positioned to engage and support a wide variety of different workpieces and may be used in diametrically opposed relation to each other, as shown for example in FIGS. 1 or 2 or may be inverted or swivelled into complementary positions, as shown for example in FIGS. 6 and 7. FIG. 2 and FIG. 4 show the manner in which the tool may be used to grip an I-beam 80, by engaging the bottom web of the I-beam in the corner between the longer and shorter legs, with the central web of the I-beam engaged by the outer edge 74 of the longer support legs. In this manner two I-beams may be aligned with each other, as shown in FIG. 4, for spot welding or tacking.

Figure 5:
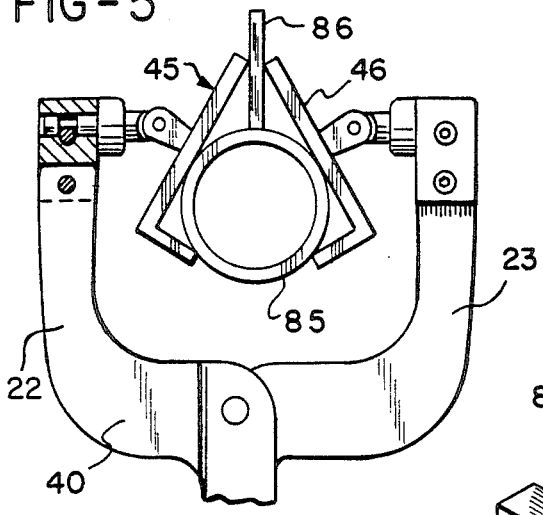
FIG. 5 is a fragmentary side view showing the manner in which the tool may be used to clamp a round or cylindrical piece and a flat piece simultaneously.

FIG. 5 illustrates the versatility of the clamping tool of this invention by the clamping of a pipe or cylindrical tube 85 and an intersecting flat plate 86 mounted in upstanding relation against the surface of the tube or radially of the tube.

Figure 6:
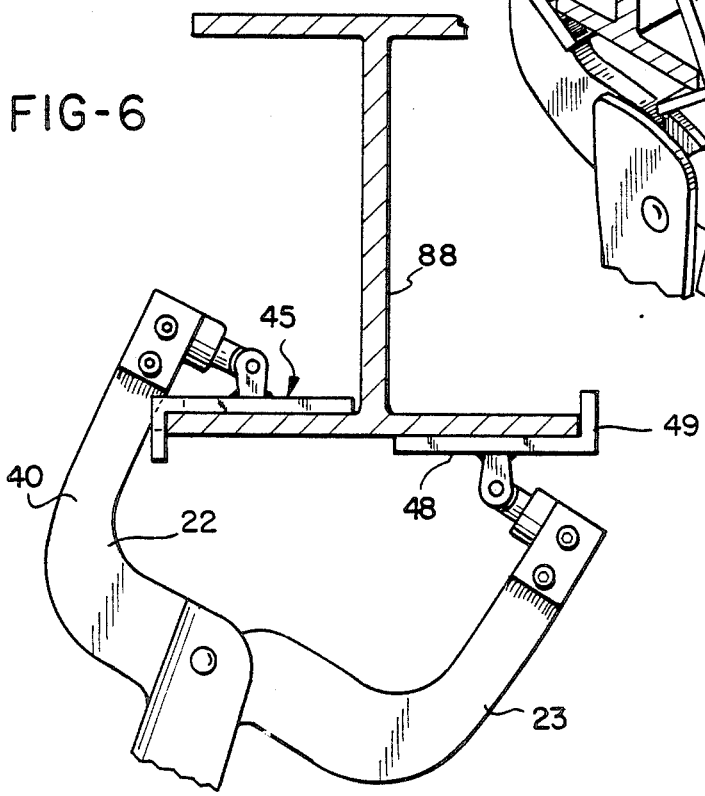
FIG. 6 is a view similar to FIG. 5 showing the tool clamped on the bottom cross member of an I-beam.

FIG. 6 illustrates the manner in which one of the support members may be rotated oppositely of the other, to provide oppositely directed short legs 49, one above and one below the bottom web of an I-beam 88, for gripping the I-beam. This arrangement may be used as an alternative to the arrangements shown in FIGS. 2 and 4.

Figure 7:
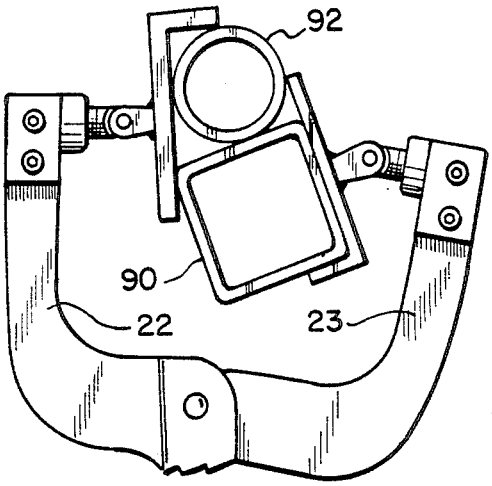
FIG. 7 is a fragmentary side view of the tool, showing a typical manner in which the tool may be used to clamp and support together two pieces of differing shapes, in this case a cylindrical tube and a square tube.

FIG. 7 is a further illustration of the versatility of the tool of this invention, in which one of the support members is inverted in relation to the other and is used to support simultaneously a rectangular tube 90 and a cyindrical tube or pipe 92.

Figure 8:
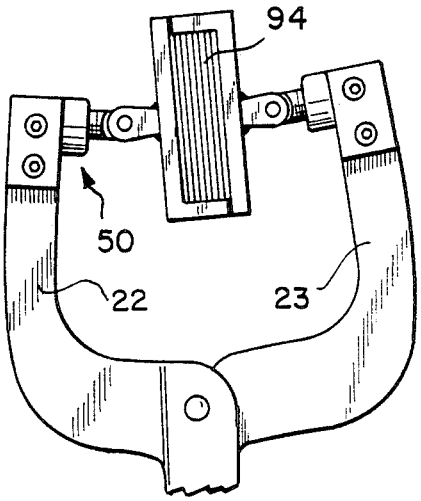
FIG. 8 is a view similar to FIG. 7 showing the manner in which the tool may be used to support and grip a plurality of flat plates.

FIG. 8 illustrates the manner in which the clamping tool of this invention may be used to clamp and support a plurality of individual flat plates 94.

Figures 9, 10, 11, 12:
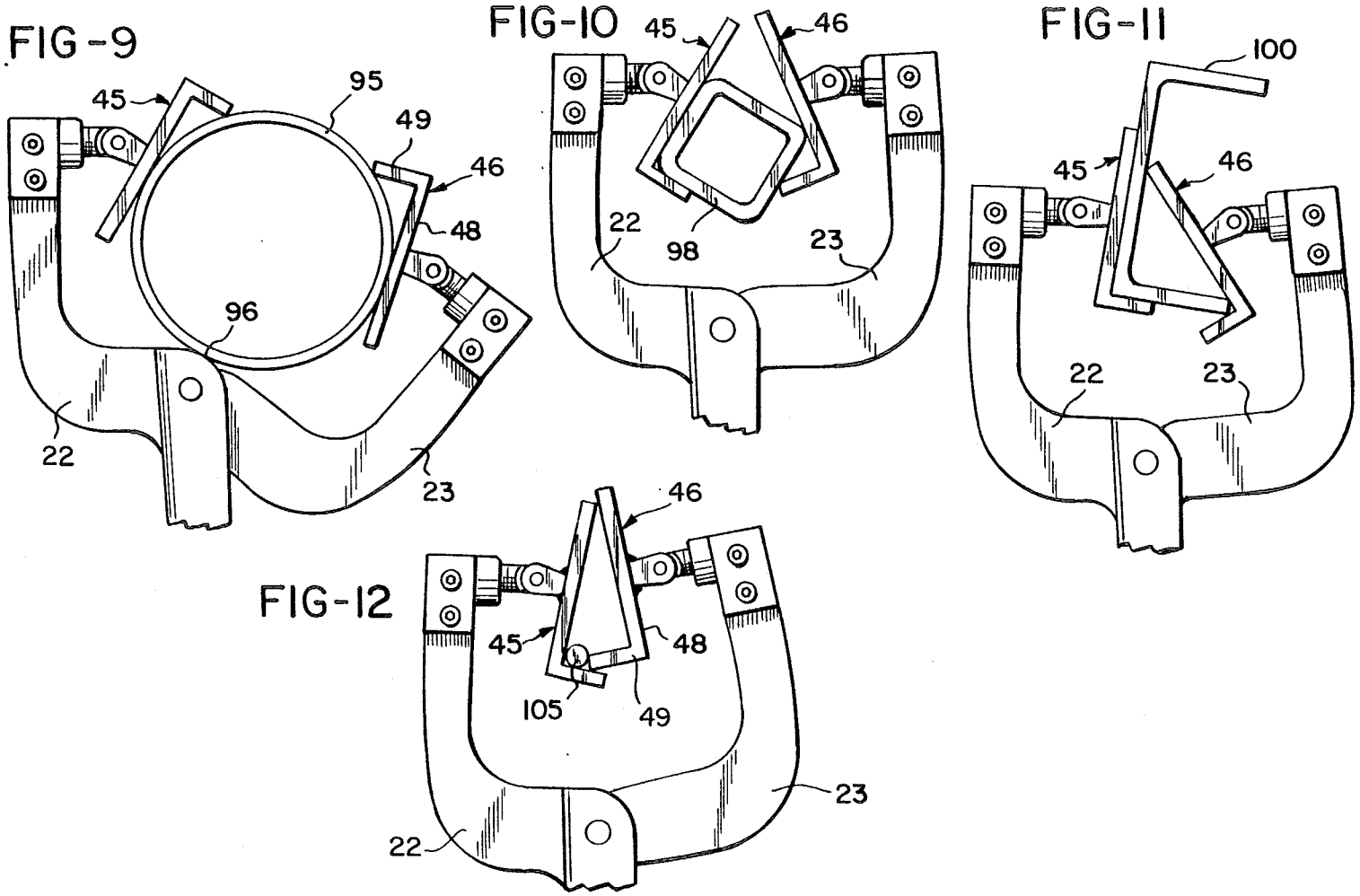
FIG. 9 shows a typical manner in which the tool may be used to clamp a large tube.
FIG. 10 shows how the tool may be used to clamp a smaller rectangular beam or tube.
FIG. 11 shows the versatility of the tool in clamping a channel.
FIG. 12 shows a typical manner in which the tool may be used to clamp small objects, such as a small rod.

FIGS. 9 through 12, which are representative only, illustrate different manners in which the tool of this invention may be used to support a wide variety of shapes. In FIG. 9, the tool supports a large pipe 95, by bringing one surface of the pipe fully within the jaws of the tool, causing it to bear upon the shoulder 96 of the fixed arm 22, with the shorter arms 49 of the clamping members rotated to the outer side of the tool and engaged at the opposite circumference of the large pipe.

FIG. 10 illustrates one manner in which a rectangular beam or pipe 98 may be supported, while FIG. 11 shows a typical manner of supporting a U-channel 100. FIG. 12 is of particular interest in that it illustrates one way of holding small diameter pieces, such as a rod 105, by causing the rod to be received within the L-shaped surface of one of the clamping members and firmly retained in this surface by the terminal edge of the shorter leg against each other.

As previously noted, the illustrations presented herewith show typical arrangements for supporting a wide variety of structural parts and members for welding and the like, but it should be understood that these are presented for illustrative purposes only, and that the user will find further examples of advantageous ways of using the clamping tool. Since each of the clamping members may be either pivoted about a transverse axis or rotated about a second axis normal to the first axis, and since each clamping member is provided with a longer and a shorter leg, the combination provides for a wide variety of configurations.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A clamping tool for use as a fixture for clamping and supporting a wide variety of elongated pieces for welding or the like, in which a pair of generally C-shaped arms, each having first and second ends, said arms being pivotally connected at said first ends, means for locking said arms whereby said arms may be moved between opened and clamped positions and locked in a clamped position, and in which the arms carry workpiece engaging elements thereon, the improvement comprising:

a pair of opposed gnerally L-shaped clamping members, one for each arm, each such clamping member having a long leg and a short leg extending generally perpendicular to the long leg and in a direction therefrom toward the opposite said clamping member, a support attached to each of said clamping members to an adjacent surface of said long leg with said short leg extending away from said support, and means for mounting each of said supports on said second end of one of said arms to provide for unrestricted rotational movement of said support about a first axis intersecting said long leg of said clamping member and for simultaneous pivotal movement of said support about a second axis generally parallel to said long leg, including a pair of swivel pins, each of said pins being connected to said second end of one of said arms for rotational movement about said first axis, each of said pins further being pivotally conencted to one of said supports providing for movement of said one support about said second axis.

2. The fixutre of claim 1 in which said support members each have a short leg which is about one-third to one-fourth the length of the long leg.

* * * * *